US005563468A

United States Patent [19]

Abe et al.

[11] Patent Number: 5,563,468

[45] Date of Patent: Oct. 8, 1996

[54] SPARK PLUG HAVING ARC-SHAPED PRECIOUS METAL CHIP AND METHOD OF PRODUCING THE SAME

[75] Inventors: Nobuo Abe, Yokkaichi; Akio Katoh, Nishio, both of Japan

[73] Assignee: Nippondenso Co., Ltd., Kariya, Japan

[21] Appl. No.: 214,208

[22] Filed: Mar. 17, 1994

[30] Foreign Application Priority Data

Mar. 18, 1993 [JP] Japan ..... 5-084086

[51] Int. Cl.[6] ..... H01T 13/20

[52] U.S. Cl. ..... 313/141; 313/144

[58] Field of Search ..... 313/141, 144; 445/46

[56] References Cited

U.S. PATENT DOCUMENTS

| | | | |
|---|---|---|---|
| 2,251,179 | 7/1941 | Weinerth . | |
| 2,630,107 | 3/1953 | Field . | |
| 3,958,144 | 5/1976 | Franks | 313/141 |
| 4,743,793 | 5/1988 | Toya et al. | 313/11 |
| 4,893,051 | 1/1990 | Kondo | 313/141 |
| 4,904,216 | 2/1990 | Kagawa et al. . | |
| 4,970,426 | 11/1990 | Bronchart | 313/141 |

FOREIGN PATENT DOCUMENTS

| | | |
|---|---|---|
| 56-45265 | 10/1981 | Japan . |
| 492383 | 3/1992 | Japan . |
| 5129063 | 5/1993 | Japan . |
| 5114455 | 5/1993 | Japan . |
| 1437142 | 5/1976 | United Kingdom . |
| 2242703 | 10/1991 | United Kingdom . |

*Primary Examiner*—Sandra L. O'Shea
*Assistant Examiner*—Vip Patel
*Attorney, Agent, or Firm*—Cushman, Darby & Cushman

[57] ABSTRACT

Method of producing a spark plug having a center electrode 1 provided with precious metal chips 31 and 32 on the tip 10. Production of the center electrode 1 is composed of a flat area formation process wherein a cylindrical center electrode 1 is formed by extrusion of metal material and wherein flat areas 111 and 113 are formed on the sides of the tip 10 of the same, a tip bonding process wherein precious metal chips 31 and 32 are bonded to the flat areas, and a plastic machining process wherein the tip 10 whereupon the precious metal chips are bonded is formed into an abbreviated cylinder by means of plastic machining. By applying an identification mark to the tip surface of the tip 10, the precious metal chips 31 and 32 can accurately and easily be arranged opposite the ground electrodes when mounting the center electrode in a metal housing.

8 Claims, 21 Drawing Sheets

SPARK PLUG HAVING ARC-SHAPED PRECIOUS METAL CHIP AND METHOD OF PRODUCING THE SAME

This application claims the benefit of the prior patent application No.5-84086 filed in Japan on Mar. 18, 1993 the content of which is incorporated hereinto by reference.

BACKGROUND OF THE INVENTION

1. Field of the Invention

This invention relates to a spark plug of which precious metal chip disposed on the side of the tip portion of the center electrode opposes the ground electrode thereof, and a method of producing the same.

2. Description of Related Art

Conventionally, for example, a spark plug is proposed of which a side of the tip portion of the center electrode opposes the ground electrode thereof, and which generates a spark discharge in the gap between the side and the ground electrode. A precious metal portion with superior resistance to erosion is provided on the side of the center electrode.

As the above-mentioned precious metal portion, for example, an alloy of platinum, iridium, and nickel (Pt—Ir—Ni) that can withstand severe conditions has been employed.

The above-mentioned precious metal portion is formed in an annular, cap-shaped, or similar configuration, and is engaged and bonded to the tip of the center electrode.

Metal material such as a heat-resistant nickel alloy is employed for the center electrode.

However, the above-mentioned conventional spark plug presents the following problem.

Briefly, the precious metal portion which suppresses erosion of the center electrode surrounds the entire side circumference of the center electrode, but the area which opposes the ground electrode is only a fraction of the total precious metal portion. For this reason, the precious metal portion on other areas serves no functional purpose, and is discarded along with the spark plug at the end of its service life.

The precious metal portion having unused areas is discarded. This is not desirable from the standpoint of resource conservation. Production cost is also increased.

In addition, when precious metal portion is employed in a cap-shaped configuration, the precious metal on the top surface of the cap is completely wasted.

The precious metal portion described above also has a smaller coefficient of linear expansion than the metal material of the center electrode.

For this reason, when an annular or cap-shaped precious metal portion is bonded to the center electrode, the precious metal portion is subjected to thermal stress due to the difference of linear expansion coefficient between the center electrode and the precious metal, and major effects are applied. Because of this, there is danger of cracks occurring in the precious metal portion.

In severe cases, this may lead to peeling or loss of the precious metal portion. The possibility also exists of peeled fragments of precious metal portion bridging the spark gap. For this reason there is the problem of an inability to withstand prolonged service life.

In this regard, in order to avoid the above-mentioned thermal stress, there exists, for example, a method whereby the above-mentioned precious metal portion is inserted into the tip of the center electrode and bonded by brazing (Japanese Patent Publication laid-open No. 4-92383.

With this method, the thermal stress of the precious metal portion and the center electrode is alleviated because of a layer of the brazing material is formed between the precious metal portion and the center electrode.

With this brazing method, however, because of reasons such as the high expense of the brazing material used and the large number of brazing processes, the production costs of the spark plug are increased.

Another method exists whereby the center electrode is formed by extrusion after an annular precious metal portion is engaged to the tip of the center electrode, thereby providing an annular precious metal portion on the side of the top of the center electrode (Japanese Examined Patent Publication No. 62-31797).

In order to achieve the practical application of this method, a method is employed to alleviate thermal stress by making the linear expansion coefficient of the precious metal portion approach the linear expansion coefficient of the center electrode.

For example, in the case where a platinum-iridium-nickel alloy is used as the precious metal portion and a nickel alloy is used as the center electrode, the linear expansion coefficient of the precious metal portion can be increased and brought closer to the linear expansion coefficient of the center electrode by increasing the nickel composition of the alloy for the precious metal portion.

However, when the alloyed composition (nickel) is increased in order to increase the linear expansion coefficient of thermal expansion of the precious metal portion, the melting point of the precious metal portion decreases, and there is danger of the amount of erosion due to spark discharge increasing. Because of this,in order to prolong the service life of the precious metal portion, extremely large amounts of precious metal must be utilized. Consequently, cost is increased.

SUMMARY OF THE INVENTION

In light of the above problem points, the present invention attempts to provide a spark plug that minimizes the amount of precious metal used, that offers outstanding bond reliability of the precious metal chip, and that can also prolong service life, and a method of producing the same.

A spark plug of the present invention has an insulator inserted and affixed within the inner bore of a metal housing provided with a ground electrode, a leg of a center electrode inserted and affixed within the inner bore of the insulator, the tip of the center electrode and the ground electrode arranged in opposition, and a precious metal chip composed of precious metal or an alloy of the same is provided on the tip of the center electrode at the location opposite the ground electrode; wherein the center electrode is cylindrical, and the precious metal chip is embedded and bonded to the side surface of the tip of the center electrode either singly or in multiple separated each other in an integrated fashion, and furthermore the outer circumferential surface of the precious metal chip is formed in an arc along the side surface of the center electrode.

The most noteworthy points of the spark plug of the invention are that the precious metal chip is embedded and bonded to the side surface of the tip of the center electrode either singly or in multiple separated each other in an integrated fashion, and that the outer circumferential surface of the precious metal chip is formed in an arc along the side surface of the center electrode.

In addition, it is preferable that an identification mark for identifying the bonding location of the precious metal chip be provided on the tip surface or the side of the center electrode.

The embedding and bonding of the precious metal chip, arc-shaped outer circumferential surface of the precious metal chip, identification mark, and the like are explained collectively in the method of production described below.

As a method of producing the spark plug, there is a method of producing a spark plug wherein an insulator is inserted and affixed within the inner bore of a metal housing provided with a ground electrode, the leg of the center electrode is inserted and affixed within the inner bore of the insulator, the tip of the center electrode and the ground electrode are arranged in opposition, and a precious metal chip composed of precious metal or an alloy of the same is provided on the tip of the center electrode at the location opposite the ground electrode; wherein the method of producing the center electrode adopts the steps of:

a flat area formation process which extrudes metal material to form the cylindrical center electrode along with forming a flat area on the side of the tip of the same;

a tip bonding process which bonds the precious metal chip to the flat area; and a plastic machining process which forms an abbreviated cylinder by means of plastic machining of the precious metal chip bonded to the tip.

The most noteworthy points of the method of production of the invention are that in producing the center electrode, first a flat area is formed on the side of the tip of the center electrode, then a precious metal chip is bonded to the flat area, then plastic machining is carried out for the tip whereupon the precious metal chip is bonded.

In the flat area formation process, the formation of the flat area can be performed during or after extrusion of the center electrode.

The flat area is the portion whereupon the precious metal chip arranged opposite the ground electrode is bonded, and one or multiple surfaces are formed, the number of which corresponds to the number of ground electrodes.

The center electrode utilizes a metal material of a composite material composed of a nickel alloy and a copper core or the like.

In the tip bonding process, methods for bonding the precious metal chip to the flat area include resistance welding, laser welding, and the like.

The precious metal chip utilizes an alloy composed primarily of precious metal such as platinum-iridium-nickel alloy, platinum-iridium alloy, platinum-nickel alloy, or the like.

It is preferable for the precious metal chip to be a flattened circular, square, or similar tip. This is because the bonding of the precious metal chip to the flat area and the plastic machining can be carried out reliably.

In the plastic machining process, swaging is preferable as the plastic machining. In the swaging, for example, a die with the inner machining surface curved in an arc is used, and the side of the center electrode is compressed by striking with this die. By means of this, the tip is formed by compression into a cylinder or abbreviated cylinder.

The cylinder refers to a shape whose cross section is an abbreviated round, as shown in FIG. 1 (*d*). The abbreviated cylinder refers to a shape each of which the outer circumferential surface of the center electrode and precious metal chip lie on an abbreviated circle, as shown in FIG. 1 (*c*), and the flat area of the center electrode is not formed with perfect circularity.

In addition, component rolling may be utilized as the plastic machining. In the component rolling, as an example, multiple machining rollers arranged on the circumference of the same circle apply radial force to the sides of the center electrode with rolling state. By means of this, the tip is formed by compression into an abbreviated cylinder.

Additionally, in the method of production for the spark plug, there exists a method of producing the spark plug wherein prior to the plastic machining process a mark application process is provided to create an identification mark for identifying the bond location of the precious metal chip; whereafter a leg affixing process is carried out to insert and affix the leg of the center electrode for which the plastic machining process has been carried out within the inner bore of the insulator; whereafter a mounting process is carried out, when inserting and affixing the insulator affixed with the center electrode in the inner bore of the metal housing, to position the location of the identification mark at the prescribed position and to mount and affix the insulator within the inner bore of the metal housing in such a way that the precious metal chip provided on the center electrode is located opposite the ground electrode.

The identification mark indicates a determined direction with respect to the location of the precious metal chip, and is formed, for example, on the surface of the tip of the center electrode. It can also be formed on the side of the tip of the center electrode.

The identification mark may have a three-dimensional configuration such as, for example, a groove, protrusion, horn, or the like. Alternatively, a line, multiple points, or the like may be drawn in a flat configuration on the tip surface, side surface, and so on of the center electrode.

The identification mark of horn configuration can be formed simultaneously when, for example, conducting plastic machining of the tip of the center electrode.

The identification mark of line or point configuration differs in surface luster and surface roughness from other areas of the tip surface or the like. By means of this, the identification mark of line or point configuration is recognized by a visual-recognition device such as a CCD camera.

The mark application process is carried out prior to the plastic machining process.

It is preferable that the mark application process is executed in the flat area formation process.

In this case, the identification mark is applied so as to indicate the determined direction with respect to the flat area, i.e., the location whereupon the precious metal chip is to be bonded.

Thereafter, in the mounting process described below, the location and direction of the identification mark are recognized by a visual-recognition device such as a CCD camera, and the center electrode is rotated. The location of the identification mark is thereby positioned in such a way that the precious metal chip opposes the ground electrode.

By means of this, the precious metal chip is arranged opposite the ground electrode.

In the leg affixing process, the leg of the center electrode is inserted into the inner bore of the insulator, and these are secured by glass welding or the like, in a manner similar to that of the prior art.

In the affixing process, the location of the identification mark is positioned at the prescribed location as described above when the insulator, in which the center electrode is inserted and affixed is inserted within the inner bore of the metal housing and affixed, by crimping or the like, or prior to inserting the insulator into the housing. The opposing positions of the precious metal chip and the ground electrode is adjusted.

The metal housing is provided in advance with a ground electrode. It is desirable that the discharge area of the ground electrode is a concave curve concentric with the tip of the center electrode arranged opposite the discharge area (see FIG. 11). By means of this, the discharge area of the ground electrode has a larger surface area opposite the metal housing, and spark discharge of greater stability can be obtained.

In the spark plug of this invention, the precious metal chip is bonded to the tip of the center electrode only at the location opposite the ground electrode. Because of this, the required minimum of precious metal or precious metal alloy corresponding to the service life of the spark plug is utilized.

Therefore, there is no wasted usage of resources. Additionally, the cost of the spark plug can be made less expensive, which is economical.

In addition, the precious metal chip is partially bonded to the side of the tip of the center electrode, and precious metal is not provided in an annular configuration around the entire circumference of the tip as in the prior art.

Because of this, even if the thermal expansion coefficients of the center electrode and precious metal chip differs, the tip of the center electrode can absorb and alleviate the thermal stress of the precious metal chip.

For this reason, no cap-shaped or annular precious metal material is tightened around the entire circumference of the sides of the center electrode as in the prior art.

Therefore, no cracking occurs in the precious metal chip, and resistance to erosion is excellent. For this reason, a spark plug with a prolonged service life can be obtained.

In addition, the precious metal chip is plastically formed in an abbreviated cylinder after bonding to the flat area of the center electrode. At this time, the surface of the precious metal chip is bowed into an abbreviated cylinder. Because of this, in the case when the precious metal chip is assembled on the metal housing such that the same is arranged opposite the ground electrode, spark discharge with no variations can be generated even if there is slight misalignment of the positions of the precious metal chip and ground electrode.

Additionally, in cases when the positions of the precious metal chip and ground electrode are misaligned, the area of the center electrode closest to the ground electrode is always the precious metal chip. Because of this, no spark discharge is generated between an area of the center electrode where the precious metal chip is not bonded and the ground electrode. Erosion of the center electrode due to spark discharge can therefore be suppressed.

In addition, the superior spark plug described above can be obtained by the method of production of the invention.

Additionally, with this method of production, because the rear surface of the precious metal chip is embedded in the side of the center electrode by plastic machining, the reliability of the bond with the tip of the center electrode is superior.

Additionally, in performing provisional bonding of the precious metal chip to the flat area of the center electrode in advance of the plastic machining, there is no restriction in the method of bonding, and an ordinary simplified method of bonding can be carried out. Because of this, a bonding method such as resistance welding which is inexpensive and suited to mass production can be performed.

With this invention, as has been described above, a spark plug and method of producing the same can be provided wherein the amount of material used for the precious metal chip is minimized, the bond reliability of the precious metal chip is superior, and prolonged usage is possible.

DETAILED DESCRIPTION OF THE EMBODIMENTS

First Embodiment

The spark plug and method of producing the same for an embodiment of the invention are explained in FIG. 1 to FIG. 9.

Figure 2:
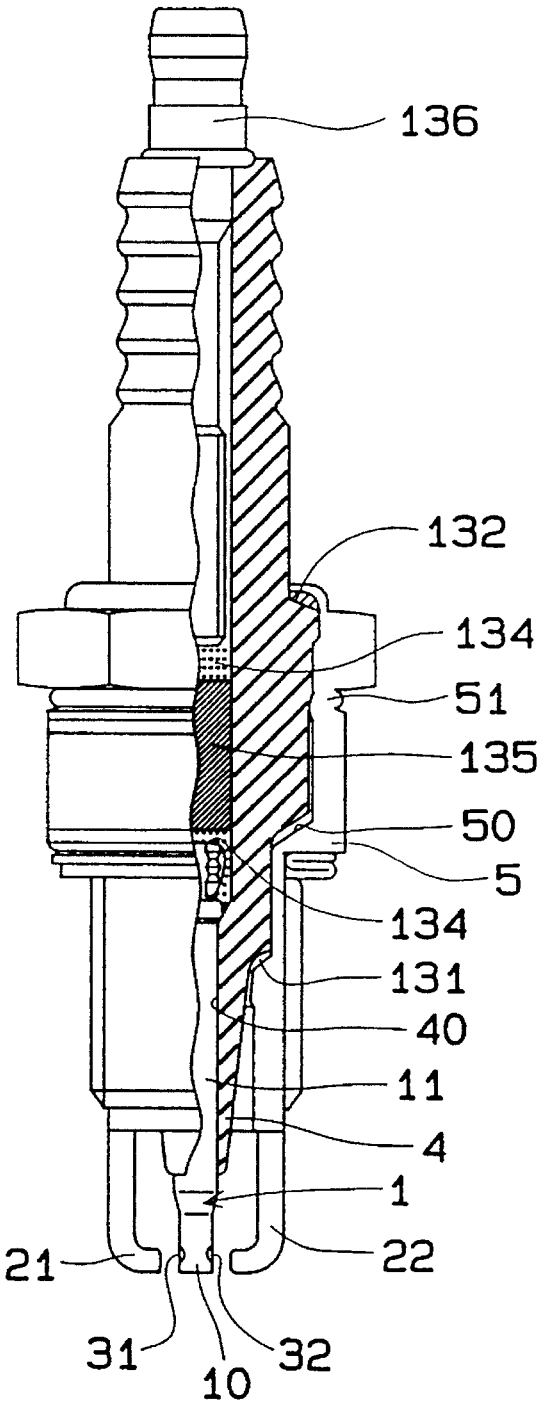
FIG. 2 is a partial cross-sectional view of the spark plug of the first embodiment.

As shown in FIG. 2, the spark plug has an insulator 4 inserted and affixed in an inner bore 50 of a metal housing 5 provided with ground electrodes 21 and 22. A leg 11 of a center electrode 1 is inserted and affixed within an inner bore 40 of the insulator 4.

A tip 10 of the center electrode 1 is arranged opposite the pair of ground electrodes 21 and 22. Precious metal chips 31 and 32 are provided on the locations on the tip 10 opposite the ground electrodes 21 and 22.

Figure 1A:
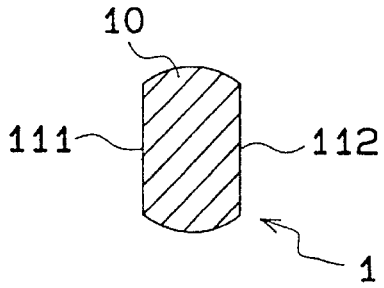
FIGS. 1A to 1D are explanatory views of the production process of the spark plug of the first embodiment.
Figure 1B:
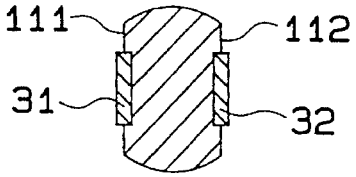
Figure 1C:
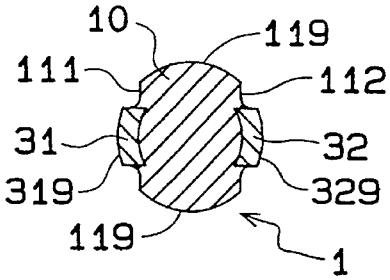
Figure 1D:
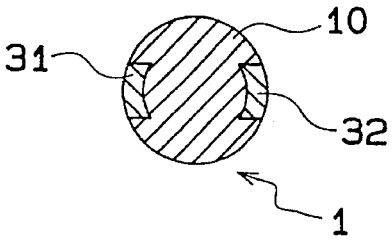
Figure 8A:
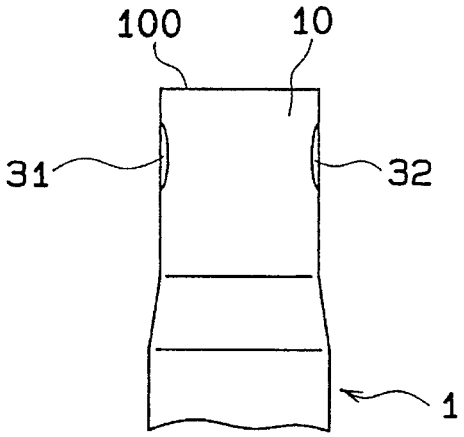
FIGS. 8A and 8B are front view and cross-sectional view of the center electrode machined in the plastic machining process of the first embodiment.
Figure 8B:
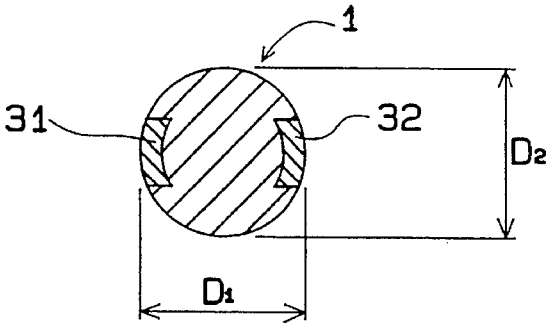

The precious metal chips 31 and 32 are embedded and bonded at the sides of the tip 10 on the cylindrical center electrode, as shown in FIGS. 1D, 8A and 8B, and along with this the outer circumferential surface of the precious metal chips 31 and 32 is formed in an arc shape along the side of the center electrode 1.

Figure 9:
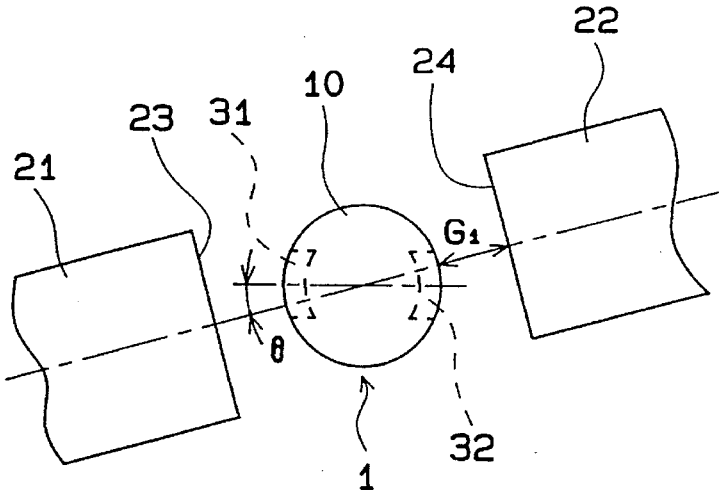
FIG. 9 is an explanatory view depicting the layout of the precious metal chips of the center electrode and the ground electrodes of the spark plug of the first embodiment.

The tips of the ground electrodes 21 and 22 respectively have flat discharge areas 23 and 24, as shown in FIG. 9.

Next is an explanation regarding the method of producing the spark plug.

First, in manufacturing the center electrode, metal material is extruded and formed into a cylindrical center electrode 1, as shown in FIG. 1A, and along with this a flat area formation process is carried out to form flat areas 111 and 112 on the sides of the tip 10 of the same.

Next, as shown in FIG. 1B, a tip bonding process is carried out to bond the precious metal chips 31 and 32 to the flat areas 111 and 112.

Next, as shown in FIGS. 1C and 1D, a plastic machining process is carried out to form the tip 10 on which the precious metal chips 31 and 32 are bonded into an abbreviated cylinder configuration by means of plastic machining.

By these means, this center electrode 1 is obtained.

A detailed explanation regarding the method of production in FIG. 2 to FIG. 8B is following.

Figure 3A:
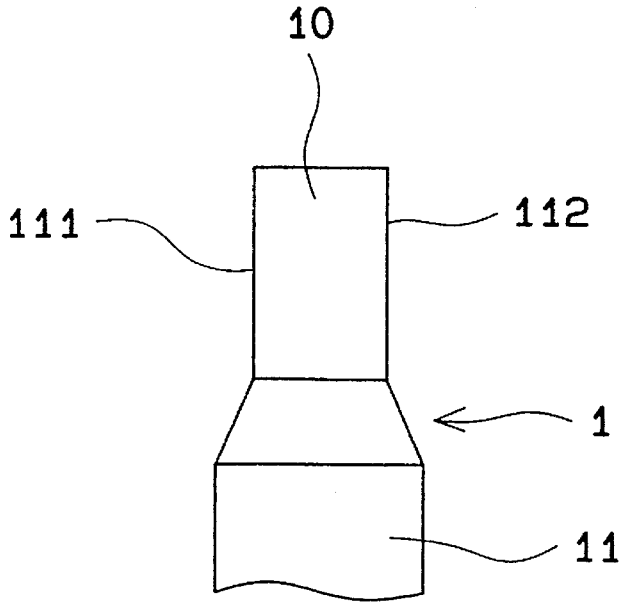
FIGS. 3A and 3B are front view and plan view of the center electrode in the flat area formation process of the first embodiment.
Figure 3B:
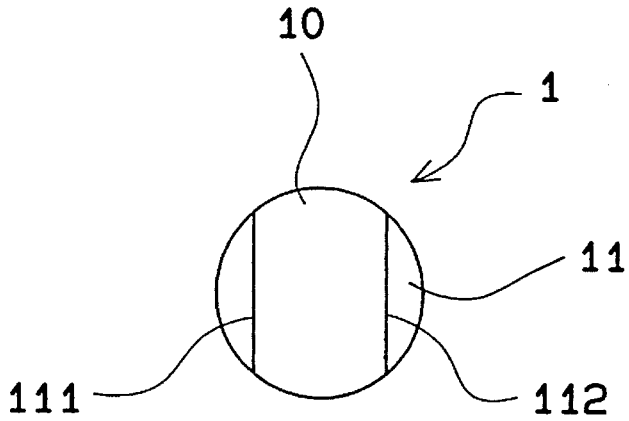

First, in the flat area formation process, as shown in FIGS. 1A, 3A and 3B, a composite material composed of nickel alloy and copper core is extruded to form a cylindrical center electrode 1. Flat areas 111 and 112 are also formed on the sides of the tip 10 of the center electrode 1.

The flat areas 111 and 112 is formed during the extrusion of the center electrode 1, or by cutting away or squashing both sides after extrusion.

Figure 4:
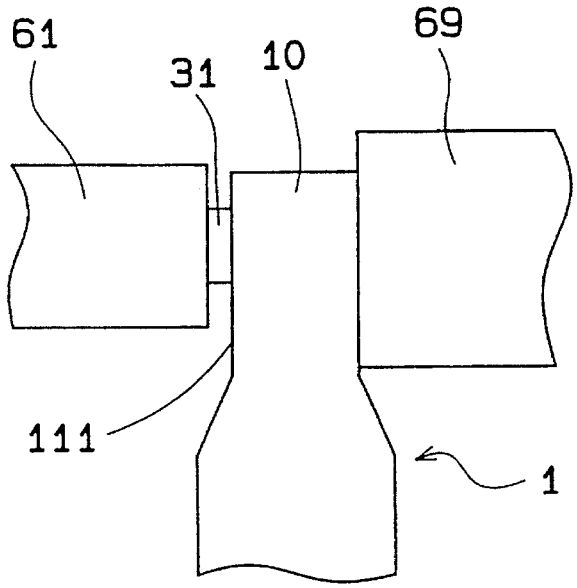
FIG. 4 is an explanatory view of the tip bonding process of the first embodiment, following FIGS. 3A and 3B.

Next, in the tip bonding process, as shown in FIG. 4, a precious metal chip 31 is bonded to one flat area 111. In bonding, resistance welding is performed, i.e. the tip 10 and precious metal chip 31 are pressed with electricity is conducted by the welding electrodes 61 and 69.

Figure 5:
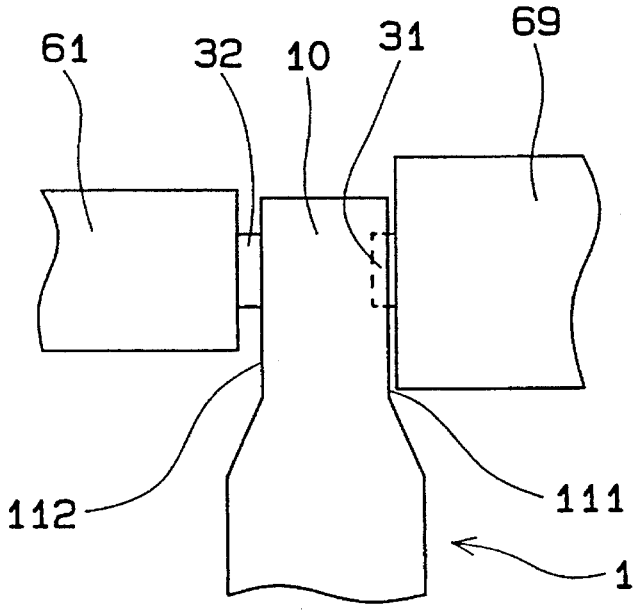
FIG. 5 is an explanatory view of the tip bonding process, following FIG. 4.
Figure 6A:
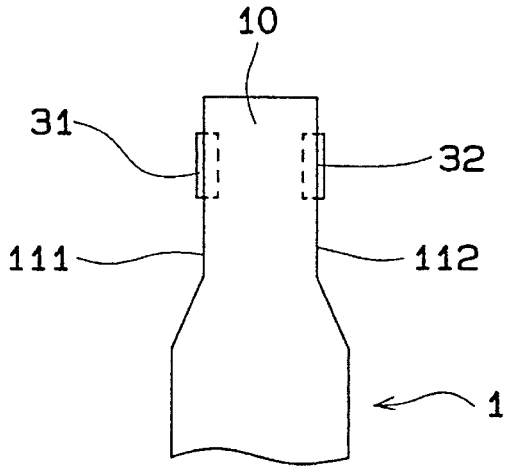
FIGS. 6A to 6C are front view, plan view and perspective view of the center electrode whereupon precious metal chips are bonded and tip bonding process of the first embodiment.
Figure 6B:
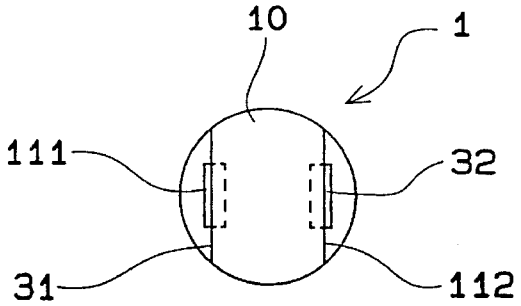
Figure 6C:
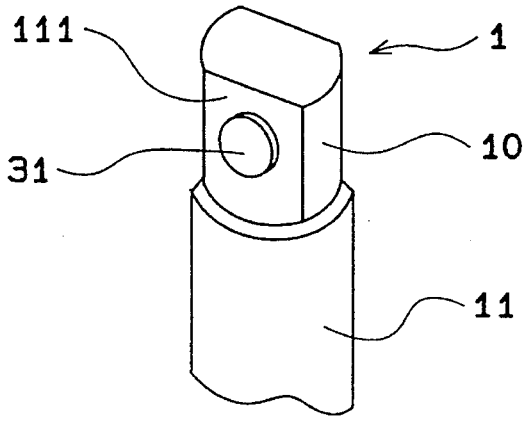

Next, as shown in FIG. 5, the precious metal chip 32 is welded to the other flat area 112 in a manner similar to that just described.

By these means, as shown in FIGS. 1B and 6A to 6C, the precious metal chips 31 and 32 are bonded to the respective flat areas 111 and 112 on the tip 10 of the center electrode 1.

The precious metal chips 31 and 32 are cylinders of 0.9 mm in diameter and 0.4 mm in thickness, utilizing an alloy of 78% platinum by weight, 20% iridium by weight, and 2% nickel by weight.

Figure 7:
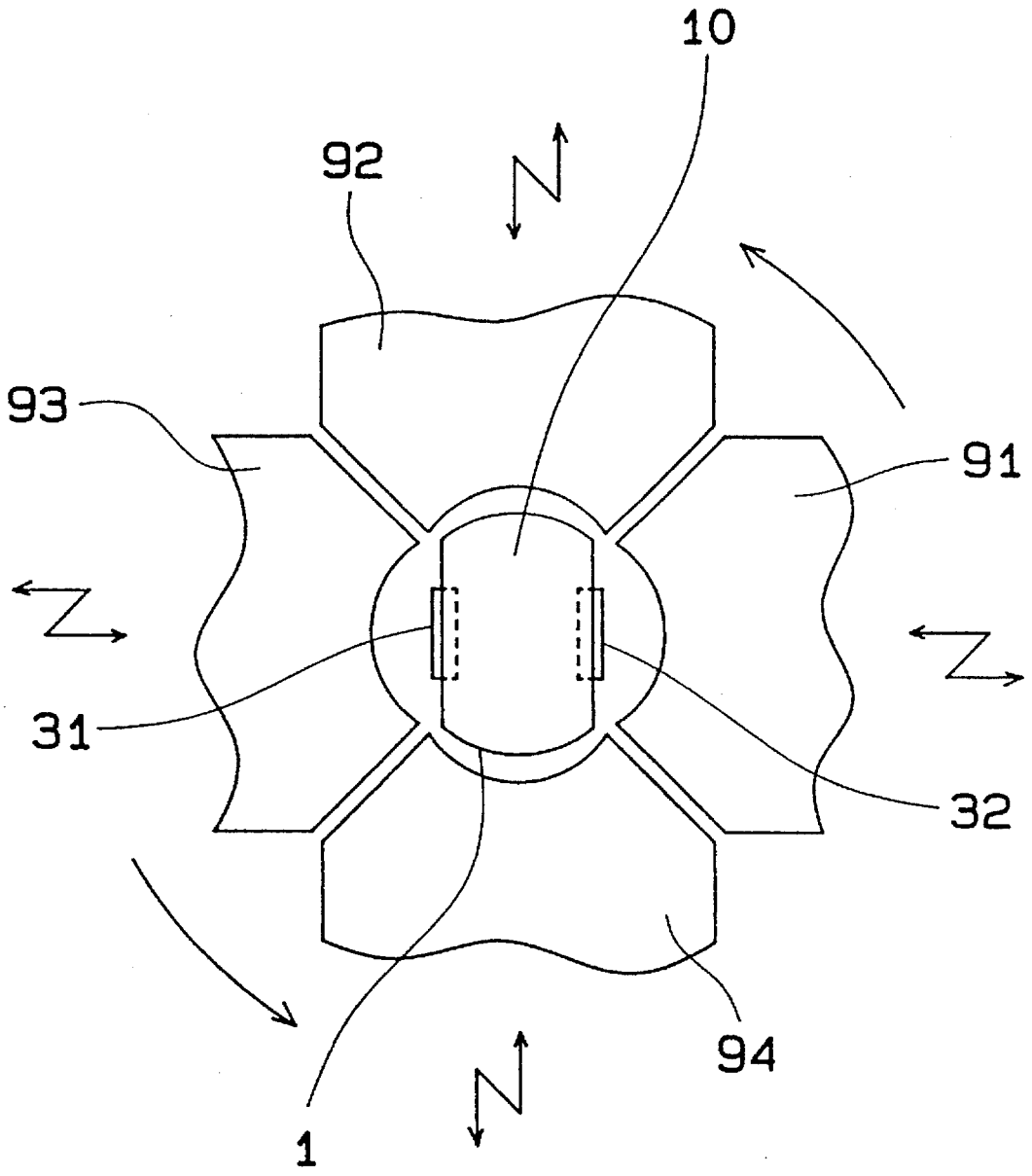
FIG. 7 is an explanatory view of the plastic machining process of the first embodiment, following FIGS. 6A to 6C.

Next, in the plastic machining process, as shown in FIG. 7, the tip 10 in which the precious metal chips 31 and 32 are bonded is formed into an abbreviated cylinder by means of plastic machining, in particular swaging.

In carrying out the plastic machining, multiple teeth 91 to 94 each of which machining surface is bowed into an concave arc are used. While these teeth are rotated around the center electrode 1, these teeth strike the sides of the center electrode and apply force radially.

In addition, along with compressing the sides of the center electrode 1 with the teeth, compression is carried out until the surface of the tip of the center electrode reaches the prescribed axial machined length.

By these means, as shown in FIGS. 1D, 8A and 8B, the tip 10 and tip surface 100 are compressed into a cylindrical configuration. Additionally, it is also acceptable for the configuration of the tip 10 to be the abbreviated cylinder depicted in FIG. 1C. That is to say, for the center electrode depicted in FIG. 1C, the precious metal chips 31 and 32 are not completely embedded in the center electrode 1, and as shown in FIG. 1D, the cross section is not truly circular. However, the outer circumferential surface 119 of the center electrode 1 and the outer circumferential surfaces 319 and 329 of the precious metal chips 31 and 32 lie on virtually the same circle.

In addition, the tip surface 100 of the center electrode 1 is formed flat by compression by the die.

Next as shown in FIG. 2, the leg 11 of the center electrode 1 is inserted into the inner bore 40 of the insulator 4. Subsequently, conductive glass 134 and an internal resistor 135 are emplaced within the inner bore, and a terminal 136 is inserted.

Next, the insulator 4 is heated to fuse the conductive glass 134. By these means, the insulator 4, center electrode 1, conductive glass 134, internal resistor 135, and terminal 136 are integrated into a single unit.

Meanwhile, the ground electrodes 21 and 22 are welded in advance to the metal housing 5, which is machined by bending to the prescribed configuration and orientation.

Next, the insulator 4 formed as a single unit with the center electrode 1 as described above is positioned such that the precious metal chips 31 and 32 of the center electrode 1 are arranged opposite the ground electrodes 21 and 22.

The insulator 4 is thereby inserted and affixed within the inner bore 50 of the metal housing 5, and the precious metal chips 31 and 32 of the center electrode 1 are arranged opposite the ground electrodes 21 and 22.

At this time, gaskets 131 and 132 are simultaneously installed in order to assure the air-tightness between the insulator 4 and metal housing 5.

Subsequently, high voltage is applied to the upper and the lower ends of the metal housing 5, and the body 51 of the metal housing 5 is compressed and crimped. By these means, the insulator 4 is affixed and integrated to the metal housing 5 and yield the spark plug.

Next is an explanation regarding the mode of operation and effects of this embodiment.

In the above-mentioned spark plug, the precious metal chips 31 and 32 are bonded to the tip 10 of the center electrode 1 only at those locations which lie opposite the respective ground electrodes 21 and 22. Because of this, the required minimum of precious metal alloy used for the spark discharge of the spark plug is utilized.

Nearly all of the precious metal chips 31 and 32 is therefore utilized effectively in spark discharge, with virtually no unused portions, and these are discarded along with the spark plug at the end of its service life.

Therefore, there is no wasted usage of resources. Additionally, the cost of the spark plug can be made less expensive, which is economical.

In addition, the precious metal chips 31 and 32 are partially bonded to the sides of the tip 10 of the center electrode 1.

Because of this, the tip 10 of the center electrode 1 can absorb and alleviate the thermal stress of the precious metal chips 31 and 32, even if the thermal expansion coefficients of the center electrode 1 and precious metal chips 31 and 32 differ.

Because of this, resistance to erosion is superior, with no occurrence of cracking in the precious metal chips 31 and 32. For this reason, the service life of the spark plug can be extended.

Additionally, because the precious metal chips 31 and 32 are embedded in the sides of the center electrode 1 by performing plastic machining, the reliability of the bond with the tip 10 of the center electrode 1 is superior.

In addition, in bonding the precious metal chip, an ordinary bonding method—moreover, simplified resistance welding or the like—is performed. Because of this, the spark plug can be manufactured at low cost and in large quantities.

Additionally, as shown in FIG. 9, in cases when the center electrode 1 is installed in the metal housing such that the ground electrodes 21 and 22 oppose the precious metal chips 31 and 32, there may be cases when the rotational misalignment of the center electrode 1 with respect to the centerline of the ground electrodes 21 and 22 is unavoidable.

In the spark plug of the present embodiment, however, because the tip 10 of the center electrode 1 and the precious metal chips 31 and 32 are bowed into an abbreviated cylinder, this rotational displacement exerts no adverse effect on spark discharge.

That is to say, when the tip 10 of the center electrode 1 is made cylindrical by means of plastic machining, there is virtually no fluctuation in the spark gap G1 even if rotational misalignment exists.

In addition, even if the rotational misalignment is large, the areas of the center electrode 1 closest to the ground electrodes 21 and 22 are always the precious metal chips 31 and 32. Because of this, spark discharge is always produced between the precious metal chips 31 and 32, and the ground electrodes 21 and 22.

For this reason, no sparking is generated between areas of the center electrode where the precious metal chips 31 and 32 are not bonded, and the ground electrodes 21 and 22. Because of this, erosion of the center electrode due to spark discharge can be suppressed.

First comparison

This example is a comparison with the spark plug of the first embodiment.

Figure 10:
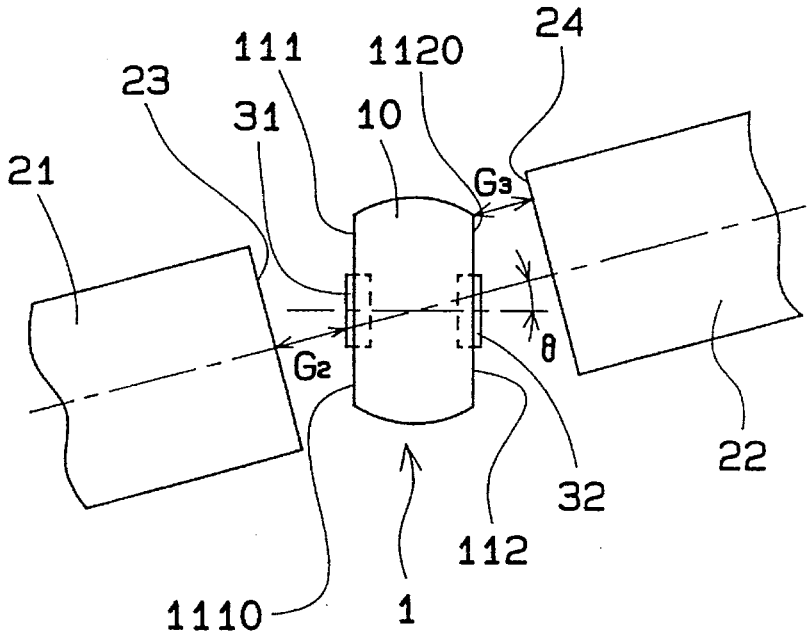
FIG. 10 is an explanatory view depicting the layout of the precious metal chips of the center electrode and the ground electrodes of the spark plug of the first comparison.

As shown in FIG. 10, a center electrode that no plastic machining has been performed, i.e., a center electrode 1 upon of which flat areas 111 and 112 precious metal chips 31 and 32 have only been bonded, is installed in the metal housing in the similar manner described above.

In this case, the cross section of the center electrode 1 is no longer linearly symmetrical with respect to the centerline of the ground electrodes 21 and 22 because of the rotational misalignment between the ground electrodes 21 and 22 and the precious metal chips 31 and 32. Because of this, the spark gaps G2 and G3 between discharge areas 23 and 24 of the ground electrodes 21 and 22 on the one hand and the precious metal chips 31 and 32 on the other vary greatly.

Additionally, in cases where the rotational misalignment is large, the edges 1110 and 1120 of the flat areas 111 and 112 become closest areas to the ground electrodes 21 and 22.

Because of this, the actual spark gaps G2 and G3 are displaced at the edges 1110 and 1120 not covered by the precious metal chips 31 and 32. Because of this, erosion of the center electrode 1 is severe so that the center electrode becomes impossible to be used in a short time.

As a result, in cases where the plastic machining indicated in the first embodiment is not carried out, the spark plug exhibits large fluctuations in quality, and service life is short.

Second comparison

In this example, a flat precious metal chip is welded to the side of a cylindrical center electrode for the purpose of comparison with the spark plug of the first embodiment.

In this case, welding is begun with the flat surface of the precious metal chip contacting the curved surface of the center electrode, but because the surface of contact area between the two is small, contact resistance is large and extreme heat is generated.

Because of this, much of the nickel alloy of the center electrode is fused and alloyed with the precious metal chip. As a result, the nickel having low melting point is dissolved in the precious metal chip, and the melting point of the precious metal chip is lowered.

In addition, a part of the fused portion is dispersed, becoming flash and degrading the appearance. Additionally, it is possible that this flash may cause bridging of the spark discharge.

In order to avoid this type of excessive fusion, reduction of the welding current may be considered, but in that case welding is inadequate. In particular, areas that do not contact at the initial welding time are virtually unwelded.

As a result, welding is liable to be inadequate in the case when the precious metal chip is flat and the side of the center electrode is curved.

Therefore, it can be seen that it is preferable to make the side of the center electrode flat and weld the precious metal chip to this, as in the first embodiment described above.

Third comparison

In this example, a curved precious metal chip is welded to the side of a cylindrical center electrode for the purpose of comparison with the spark plug of the first embodiment.

The precious metal chip is curved such that it matches the side of the cylindrical center electrode.

In this case, a complex process is required in order to curve the precious metal chip, and cost is high. Additionally, because of dimensional variations in machining, there are cases that only an extremely small area can contact, as in the welding of a flat surface to a curved surface (Second comparison).

In short, in cases where the curvature of the precious metal chip is greater than the curvature of the center electrode side, welding starts at the periphery of the precious metal chip contacting with the center electrode side.

Conversely, in cases where the curvature of the precious metal chip is less than the curvature of the center electrode side, welding starts at the center of the precious metal chip contacting with the center electrode side.

In either case, the welding between the center electrode and the precious metal chip becomes unstable, and quality is susceptible to fluctuations. Because of this, this method is unsuitable for mass production.

Second embodiment

Figure 11:
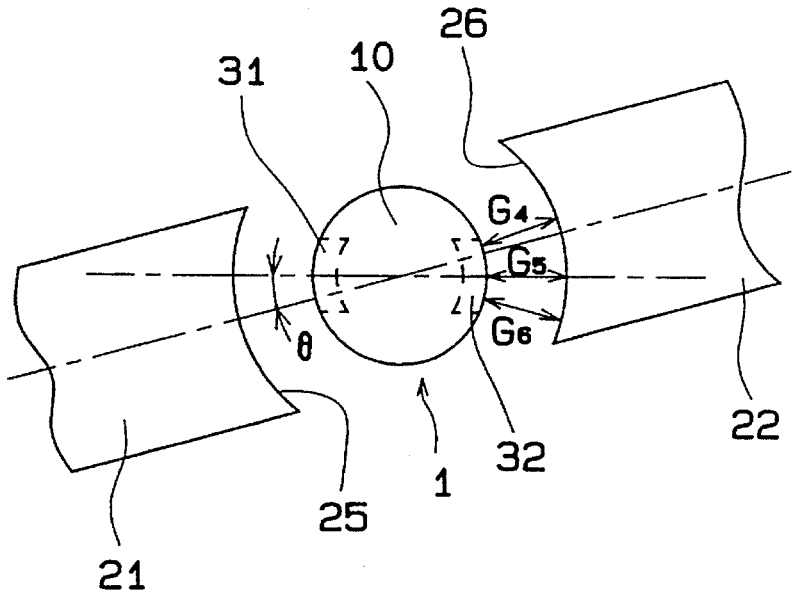
FIG. 11 is an explanatory view depicting the layout of the precious metal chips of the center electrode and the ground electrodes of the spark plug of the second embodiment.

In the spark plug of this embodiment, discharge areas 25 and 26 of the ground electrodes 21 and 22 are concave curved surfaces concentric with the tip 10 of the center electrode 1, as shown in FIG. 11.

In other respects, this embodiment is identical to the first embodiment.

In the spark plug, the surface areas of opposition between the discharge areas 25 and 26 of the ground electrodes 21 and 22 on the one hand and the precious metal chips 31 and 32 on the other are large.

Because of this, the distance between the discharge areas 25 and 26 and the precious metal chips 31 and 32 is always constant, even when the rotational misalignment of the center electrode 1 is large with respect to the centerline of the ground electrodes 21 and 22.

There is therefore no fluctuation in the spark gaps G4, G5, and G6 formed between the two elements. For this reason, sparking of greater stability can be generated.

In other respects, effects identical to those of the first embodiment can be obtained from the present embodiment.

Third embodiment

Figure 12A:
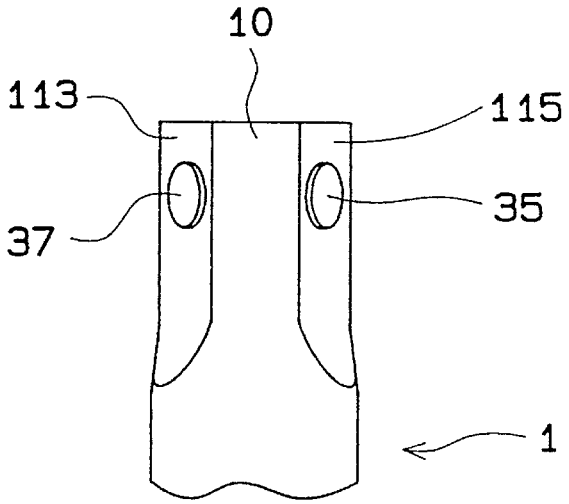
FIGS. 12A and 12B are front view and plan view of center electrode whereupon precious metal chips are bonded in the tip bonding process of the third embodiment.
Figure 12B:
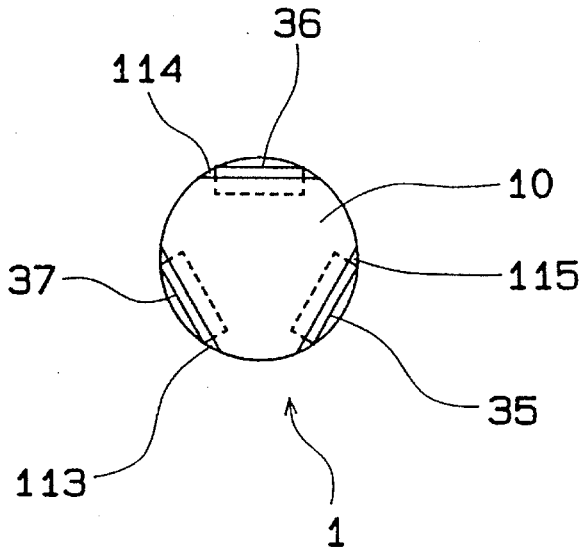

In the spark plug of this embodiment, three precious metal chips 35, 36, and 37 are bonded to the tip 10 of the center electrode 1, as shown in FIGS. 12A, 12B and 13.

Three ground electrodes (not illustrated) corresponding to the respective the precious metal chips are then provided on the metal housing.

Next is an explanation of the method of producing the spark plug.

First, the center electrode 1 is manufactured. That is to say, flat areas 113, 114, and 115 are formed at three locations on the tip 10 of the center electrode 1, as shown in FIGS. 12A and 12B.

Subsequently, the precious metal chips 35, 36, and 37 are welded to the flat areas 113, 114, and 115. 0065

Figure 13A:
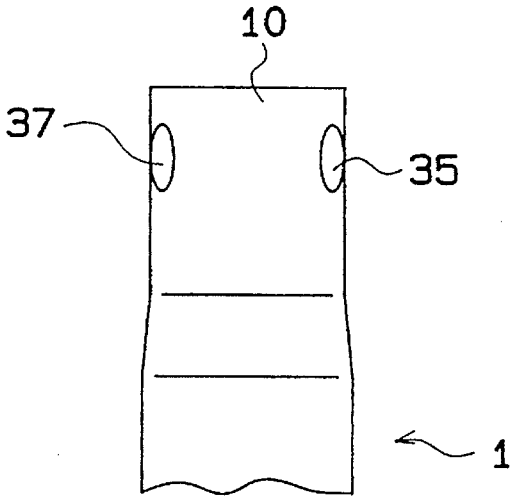
FIGS. 13A and 13B are front view and plan view of the center electrode plastically machined in the plastic machining process of the third embodiment.
Figure 13B:
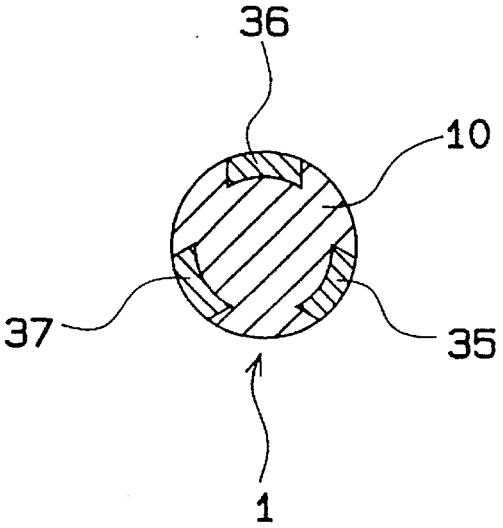

Next, plastic machining identical to that of the first embodiment is performed at the tip 10 of the center electrode 1, forming an abbreviated cylinder as shown in FIGS. 13A and 13B.

Thereafter, the center electrode 1 is affixed to an insulator in a manner identical to that of the first embodiment. Subsequently, the insulator is affixed to a metal housing provided with three ground electrodes by these means, the spark plug of the embodiment is obtained.

In other respects, this embodiment is identical to the first embodiment.

In this embodiment as well, effects identical to those of the first embodiment can be obtained.

Fourth embodiment

Figure 14A:
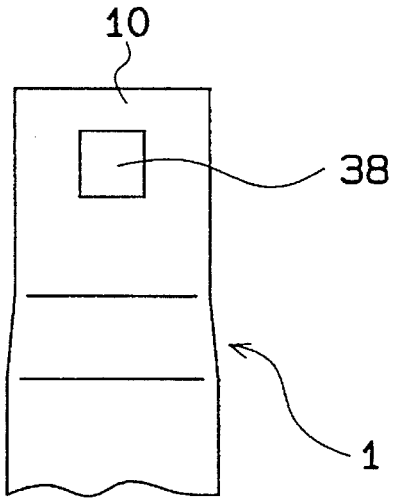
FIGS. 14A and 14B are front view and plan view of the center electrode plastically machined in the plastic machining process of the fourth embodiment.
Figure 14B:
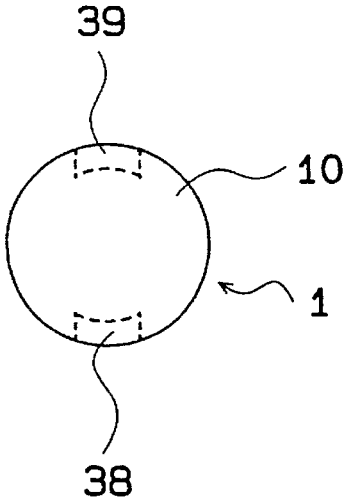

In the spark plug of this embodiment, square precious metal chips 38 and 39 are bonded to the tip 10 of the center electrode 1, as shown in FIGS. 14A and 14B. In other respects, this embodiment is identical to the first embodiment.

In this embodiment as well, effects identical to those of the first embodiment can be obtained.

Fifth embodiment

Figure 15A:
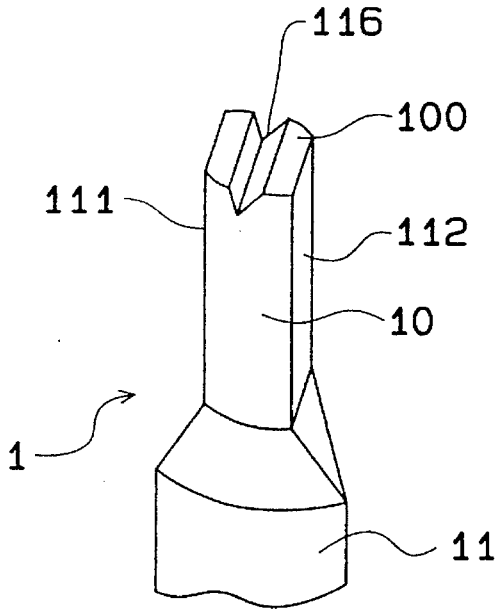
FIGS. 15A and 15B are perspective view and plan view of the center electrode in the flat area formation process of the fifth embodiment.
Figure 15B:
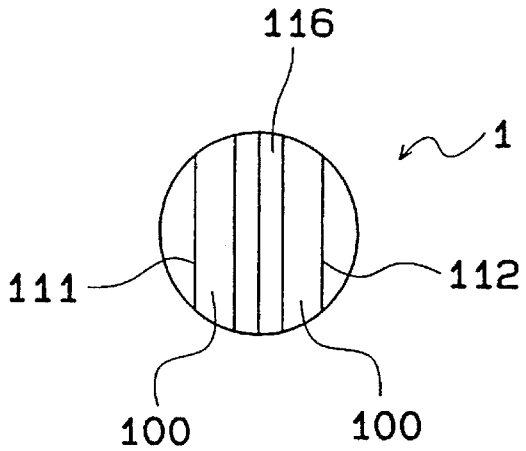
Figure 16:
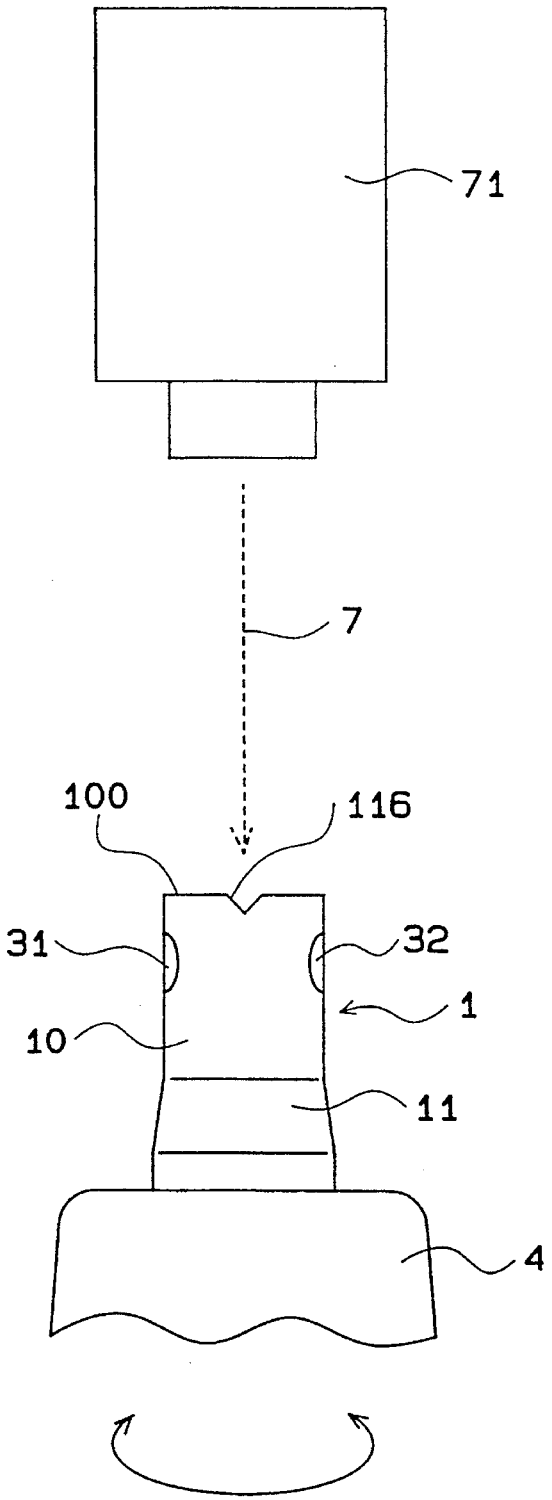
FIG. 16 is an explanatory view depicting the state of identification of the identification mark by a visual-recognition device in the fifth embodiment.

In the spark plug of this embodiment, an identification mark 116 is formed in order to identify the locations of the precious metal chips 31 and 32 on the center electrode 1, as shown in FIGS. 15A, 15B and 16.

The identification mark 116 is then recognized by a visual-recognition device 71 such as a CCD camera, and the center electrode 1 is positioned.

Following is a detailed explanation regarding the method of producing the spark plug.

First, a center electrode 1 with an identification mark 116 is manufactured, as shown in FIGS. 15A and 15B.

That is to say, flat areas 112 and 113 are provided when extruding the center electrode 1 in the flat area formation process, and along with this a mark application process is performed to provide a V-shaped groove as an identification mark 116 on the tip surface 110 of the center electrode 1.

The identification mark 116 is formed in a determined orientation with respect to the areas whereupon the precious metal chips are bonded to the flat areas 111 and 112.

The identification mark 116 is provided parallel to the flat areas 111 and 112, but a perpendicular orientation is also acceptable. It can also be oriented in an arbitrary direction.

Next, in the tip bonding process, precious metal chips 31 and 32 are resistance-welded to the respective flat areas 111 and 112 in a manner identical to that of the first embodiment.

Next, the tip 10 of the center electrode 1 is machined into an abbreviated cylinder in the plastic machining process, and subsequently the leg 11 of the center electrode 1 is inserted and affixed within the inner bore of the insulator in the leg affixing process.

Next, in the mounting process, a visual-recognition device 71 such as a CCD camera is set above the tip surface 100 of the center electrode 1, as shown in FIG. 16, and light 7 is beamed at the tip surface 100 of the center electrode 1.

At this time, the state of reflection of the light 7 at the identification mark 116 differs from that at other areas on the tip surface 100. Because of this, differences in the amount of light that is reflected are distinguished and the location and orientation of the identification mark 116, i.e., the locations of the precious metal chips 31 and 32, are identified.

Figure 17:
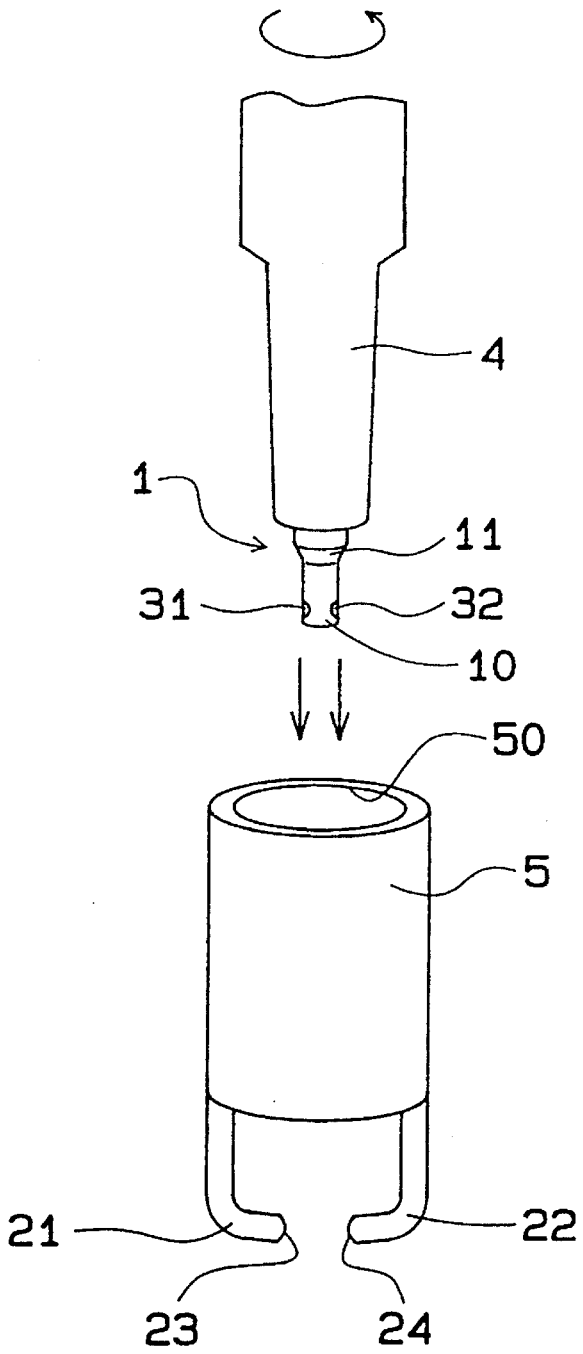
FIG. 17 is an explanatory view depicting the state of insertion of the center electrode and insulator formed as a single unit into the inner bore of the metal housing in the fifth embodiment.

Then, as shown in FIG. 17, the insulator 4 whereupon is affixed the center electrode 1 as described above is rotated by a stepping motor or the like, and the location of the identification mark 116 is positioned such that the precious metal chips 31 and 32 lie opposite the ground electrodes 21 and 22 of the metal housing 5. By these means, the precious metal chips 31 and 32 are arranged opposite the ground electrodes 21 and 22.

Next, the insulator 4 is inserted, with the current state, within the inner bore 50 of the metal housing 50, and is affixed by caulking in the manner indicated in the first embodiment.

By these means, the precious metal chips 31 and 32 of the center electrode 1 are arranged opposite the discharge areas 23 and 24 of the ground electrodes 21 and 22.

In other respects, this embodiment is identical to the first embodiment.

Next is an explanation regarding the mode of operation and effects of this embodiment.

In the spark plug of this embodiment, an identification mark 116 is formed on the tip surface 100 of the center electrode 1, as shown in FIG. 16. Because of this, the orientation of the ground electrodes 21 and 22 can be accurately aligned with the center electrode 1 by means of identification of the location and orientation of the identification mark 166 by the visual-recognition device 71.

The precious metal chips 31 and 32 bonded to the center electrode 1 can therefore be accurately arranged opposite the discharge areas 23 and 24 of the ground electrodes 21 and 22.

In other respects, effects identical to those of the first embodiment can be obtained

Sixth embodiment

Figure 18A:
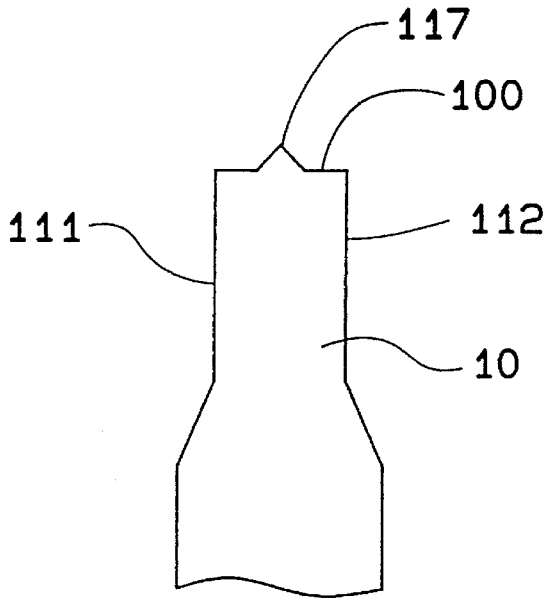
FIGS. 18A and 18B are front view and plan view of the center electrode in the flat area formation process of the sixth embodiment.
Figure 18B:
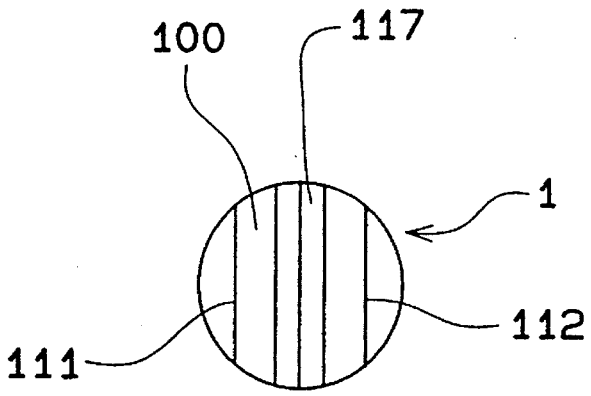

In this embodiment, a protruding identification mark 117 is applied to the tip surface 100 of the center electrode 1, as shown in FIGS. 18A and 18B. In other respects, this embodiment is identical to the fifth embodiment.

In this embodiment as well, effects identical to those of the fifth embodiment can be obtained.

Seventh embodiment

Figure 19:
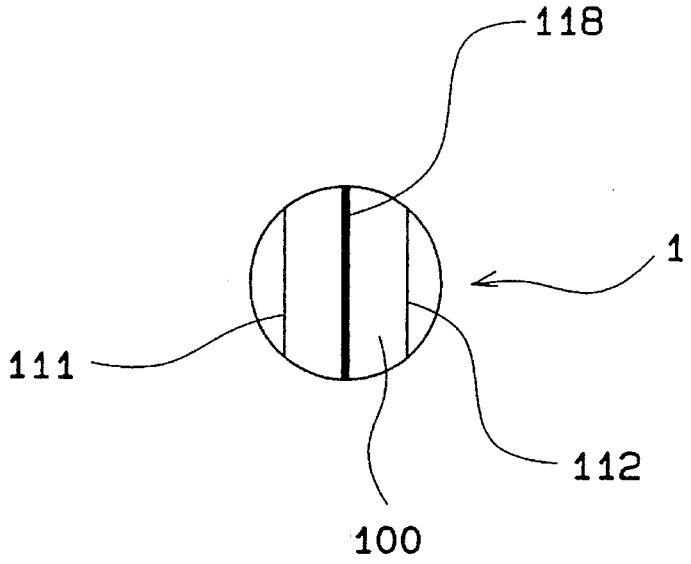
FIG. 19 is a plan view of the center electrode in the flat area formation process of the seventh embodiment.

In this embodiment, a linear identification mark 118 is applied to the tip surface 100 of the center electrode 1, as shown in FIG. 19. The identification mark 118 is formed by laser machining, and its surface roughness differs from other areas on the tip surface 100.

In other respects, this embodiment is identical to the fifth embodiment. In this embodiment as well, effects identical to those of the fifth embodiment can be obtained.

Eighth embodiment

Figure 20:
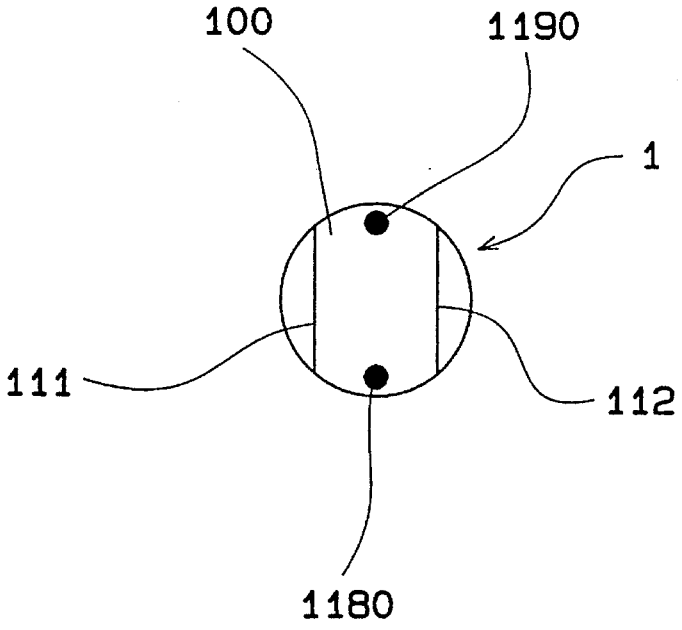
FIG. 20 is a plan view of the center electrode in the flat area formation process of the eighth embodiment.

In this embodiment, identification marks 1180 and 1190 composed of two points are applied to the tip surface 100 of the center electrode 1, as shown in FIG. 20.

In other respects, this embodiment is identical to the seventh embodiment.

In this embodiment, the identification mark 1180 and 1190 are composed of two points. Because of this, accurate alignment with the center electrode 1 can be accomplished by means of identification of the orientation of the identification marks 1180 and 1190 in the same manner as for the seventh embodiment.

In other respects, effects identical to those of the seventh embodiment can be obtained.

Ninth embodiment

Figure 21A:
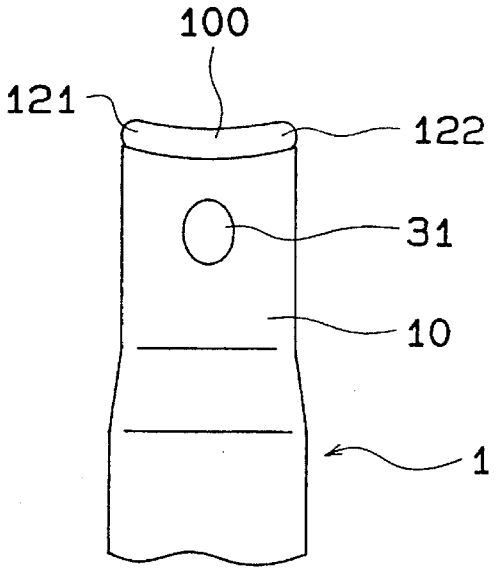
FIGS. 21A and 21B are perspective view and plan view of the center electrode machined by plastic machining in the ninth embodiment.
Figure 21B:
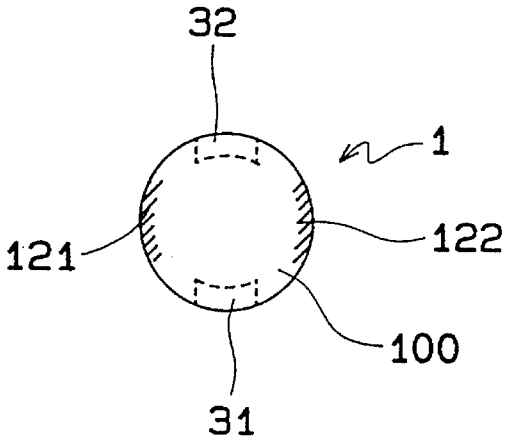

In this embodiment, horn-shaped identification marks 121 and 122 are formed on the tip surface 100 of the center electrode 1 in the plastic formation process, as shown in FIGS. 21A and 21B.

The identification marks 121 and 122 are horn-shaped and protrude to a further higher than the other areas of the tip surface 100.

In the plastic formation process, only the sides of the center electrode are compressed by the teeth, with no compression of the tip surface of the center electrode. By these means, the sides of the center electrode other than the flat areas are compressed the most by the teeth opposite those areas (see FIG. 7). The metal material of the tip is then pressed upward from the uncompressed tip surface, and in particular at the upper edges of the sides other than the flat areas.

In this manner, horn-shaped identification marks 121 and 122 are formed on the upper edges of the sides other than the flat areas, i.e., at the locations perpendicular to the precious metal chips 31 and 32.

Figure 22:
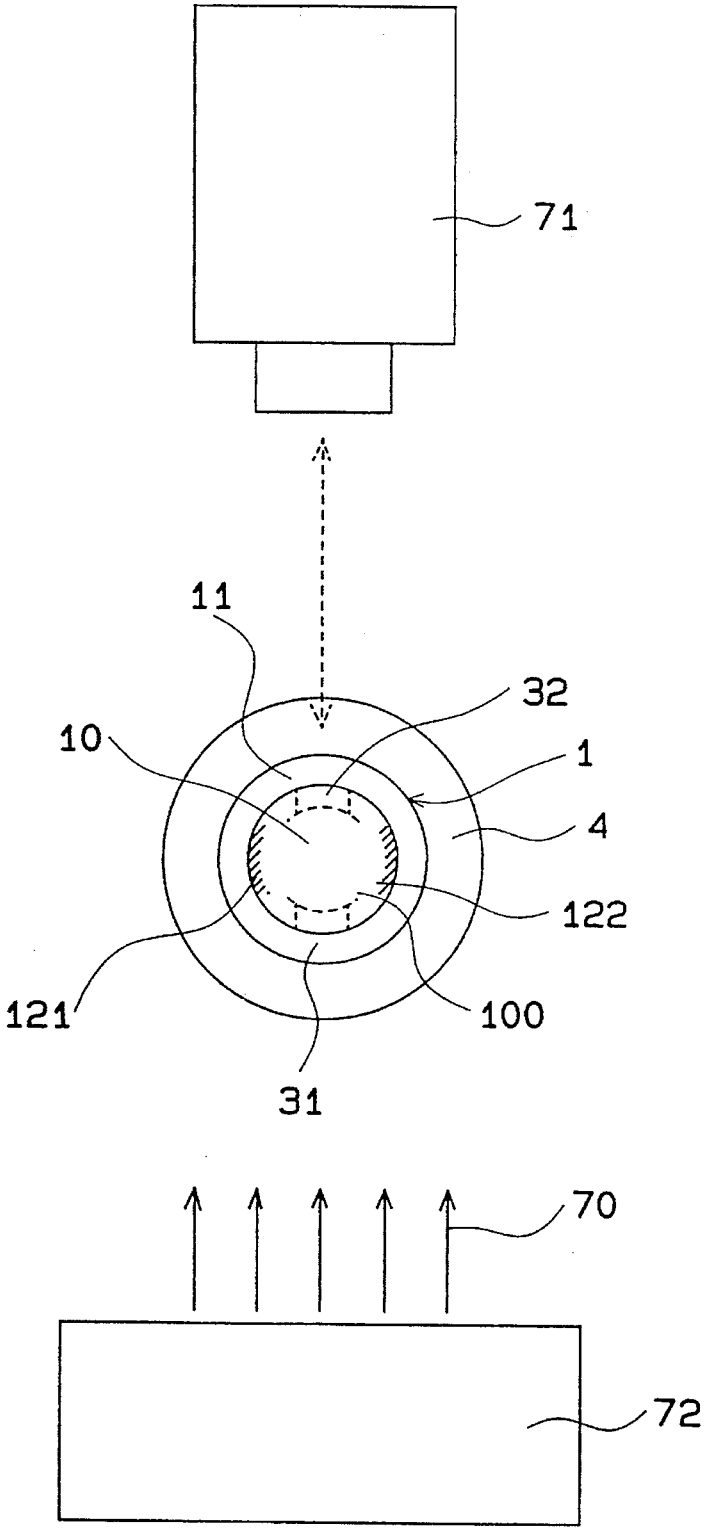
FIG. 22 is an explanatory view depicting the state of identification of the identification mark by a visual-recognition device in the ninth embodiment.

In recognizing the identification marks, a visual-recognition device 71 and light source 72 are set on either side of the center electrode 1, as shown in FIG. 22.

Light 72 is then beamed at the side of the center electrode 1 from the light source 72. At this time, the center electrode 1 is rotated by a stepping motor or the like. Because this light is interrupted by the horn-shaped identification marks 121 and 122, or otherwise passes between them, the amount of light passed varies in keeping with the rotation of the center electrode 1 and enters the visual-recognition device 71. The location and orientation of the horn-shaped identification marks 121 and 122 is therefore determined.

The center electrode 1 and insulator 4 formed as a single unit are then rotated in the manner described above and aligned accurately with the locations of the precious metal chips 31 and 32.

Thereafter, the insulator 4 is affixed to the metal housing in a manner identical with that of the fifth embodiment.

In other respects, this embodiment is identical to the fifth embodiment.

In this embodiment, the identification marks 121 and 122 are formed simultaneously with the plastic formation of the center electrode 1 in the plastic formation process. Because of this, the application of the identification marks is simplified.

In other respects, effects identical to those of the fifth embodiment can be obtained.

Tenth embodiment

Figure 23:
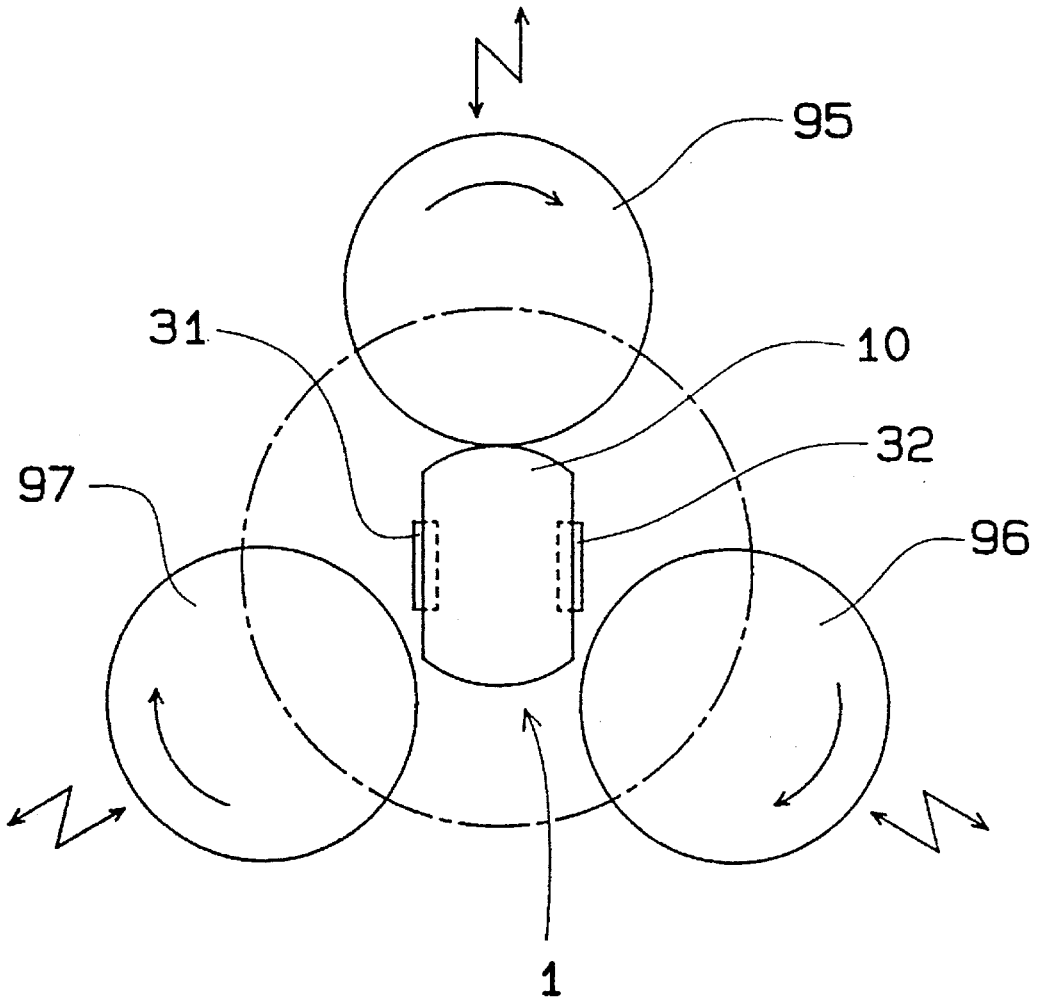
FIG. 23 is an explanatory view of the plastic machining process of the tenth embodiment.

In this embodiment, component rolling is utilized as the plastic machining, and a center electrode of an abbreviated cylinder configuration is produced, as shown in FIG. 23.

In component rolling, machining rollers 95, 96, and 97 arranged on the circumference of the same circle rotate to apply force radially to the sides of the center electrode while rotating. By means of this, center electrode 1 is compressed laterally, and the radial cross-sectional surface area is reduced. Additionally, the tip 10 of the center electrode 1 is formed by compression into an abbreviated cylinder.

In other respects, this embodiment is identical to the first embodiment so that effects identical to those of the first embodiment can be obtained.

Eleventh embodiment

Figure 24A:
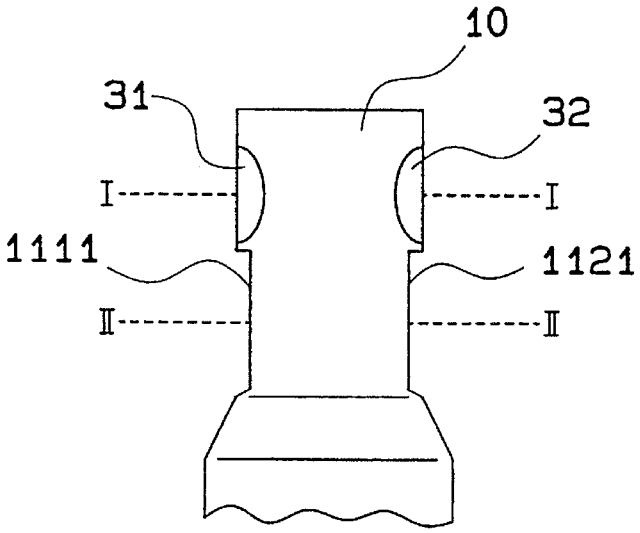
FIG. 24A is a perspective view of the center electrode machined by plastic machining in the eleventh embodiment.
Figure 24B:
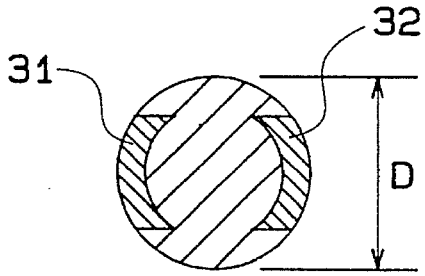
FIG. 24B is a cross-sectional view taken along the plan I—I of FIG. 24A showing the center electrode in the eleventh embodiment.
Figure 24C:
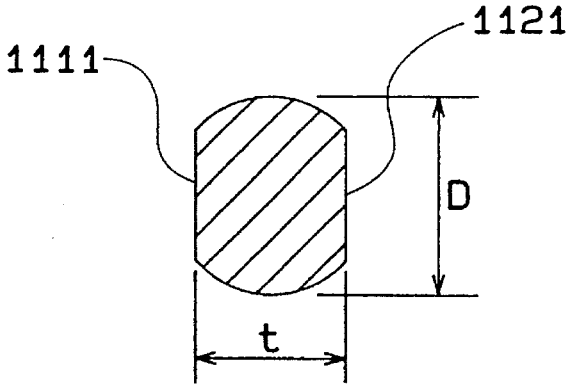
FIG. 24C is a cross-sectional view taken along the plan II—II of FIG. 24A showing the center electrode in the eleventh embodiment.

In the spark plug of this embodiment, when the center electrode is formed into a cylindrical shape by swaging or component rolling, the diameter of the tip 10 including the precious metal chip is set to match appropriately determined diameter of the tip 10 after machining, the tip 10 of the center electrode 1 including the precious metal chip 31 and 32 is formed into a circular cross section as shown in FIG. 24B, and other portion of the tip 10 not including the precious metal chip is formed to remain almost flat areas 1111 and 1121 at the same location where flat areas 111 and 112 (see FIG. 1B) have been formed prior to machining as shown in FIG. 24C.

The cross sectional area perpendicular to the axis of the center electrode at the place the precious metal chip is welded, is larger than other cross sectional area by cross sectional area of the precious metal chips. Then the appropriate diameter of the electrode which is required after machining is set. The tip 10 including the metal chips 31 and 32 is machined into a circular cross section. Other portion of the tip 10 is not machined until the circular cross section, but is machined to remain almost flat areas 1111 and 1121 at the place where flat areas 111 and 112 were formed prior to machining.

The precious metal chips 31 and 32 are welded at the same surfaces which the flat areas exist respectively. Accordingly, the position of the precious metal chips is recognized by recongnizing the position of the almost flat areas 1111 and 1121.

Figure 25:
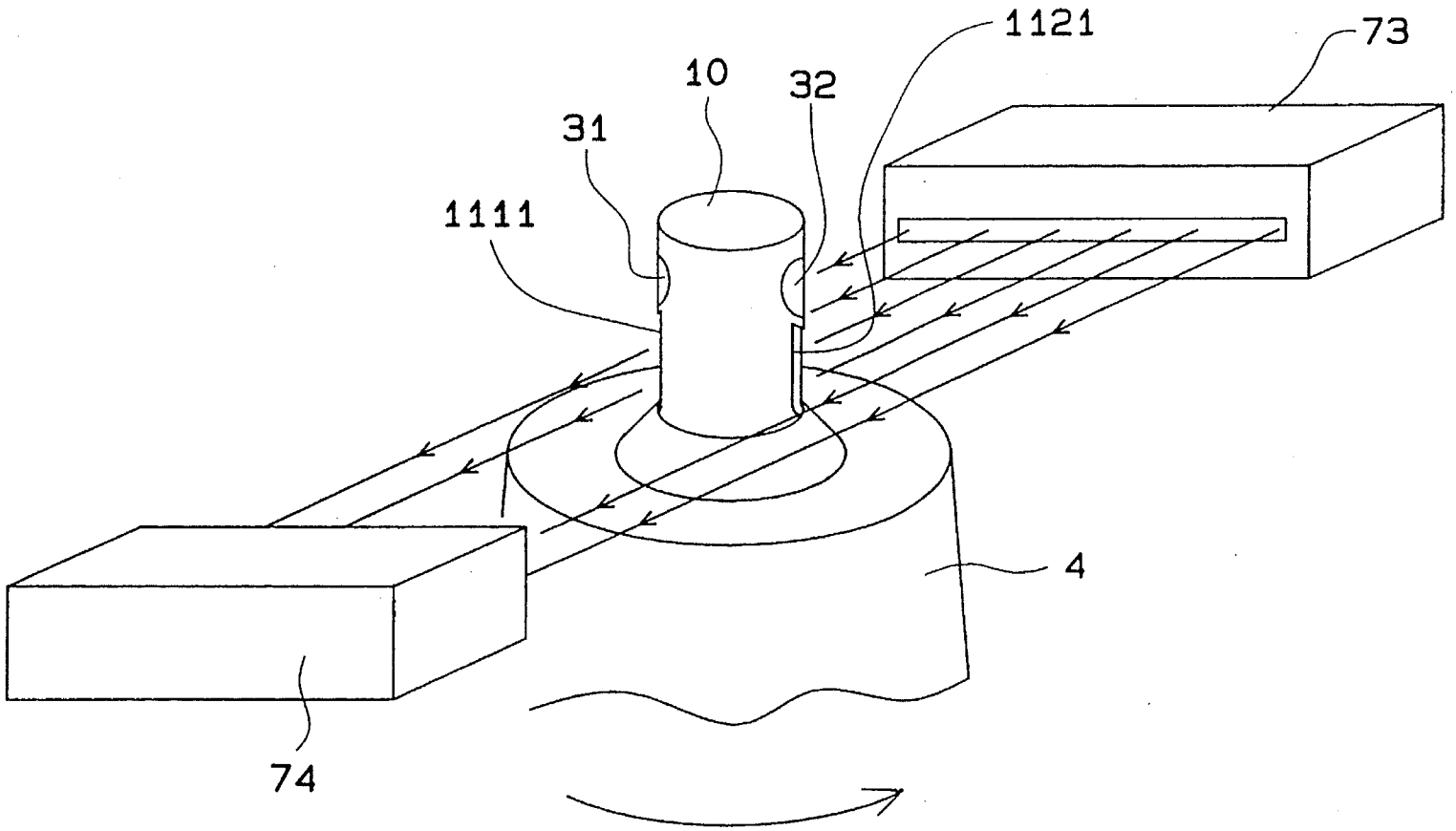
FIG. 25 is an explanatory view depicting the way of recognizing the position of the precious metal chip by a visual-recognition device in the eleventh embodiment.

A method recognizing the almost flat areas, i.e. the precious metal chips is described hereinafter. The center electrode produced as described above is installed into the insulator 4. Next, The insulator 4 formed as a single unit with the center electrode 1 is inserted and affixed within the metal housing 5. The position of the almost flat areas 1111 and 1121 are recognized by the device as shown in FIG. 25 before or after the insulator 4 is assembled with the metal housing 5. In FIG. 25, a laser light source 73 emits laser beam to aim the almost flat areas remaining of the tip 10 of the center electrode 1. The amount of light not interrupted by the tip 10 of the center electrode 1 is measured by a light-sensitive detector 74.

The amount of light is measured by rotating the center electrode 1 with step motor, or the like. The amount of the laser beam not interrupted is most obtained in the direction of the almost flat areas being parallel to the laser beam so that the amount of light measured by the light-sensitive detector 74 becomes maximum. Consequently, the position of the precious metal chips are recognized.

Further other method utilizing similar device is described hereinafter.

When a machined degree by swaging or component rolling shown in FIGS. 1A to 1D is appropriately determined, the cross sectional shape is formed into not only an approximately circular shape but also an elliptic shape. Concretely, when the tip 10 prior to machining is machined to form a round cross sectional shape, the elliptic shape is obtained by quitting the machining before the round cross sectional shape is formed. Regarding the elliptic shape, the diameter of the periphery corresponding to the flat areas 111 and 112 prior to machining responds to a short diameter $D_1$ of the elliptic shape in FIG. 8B. Since the precious metal chips are welded at the flat areas, it is possible to recognize the position of the precious metal chips by recognizing the short diameter of the elliptic shape. Therefore, in case the amount of laser beam is measured by the method in FIG. 25, the amount of laser beam is maximized when the laser beam becomes perpendicular to the short diameter in the elliptic shape. Consequently the position of the precious metal chips are recognized.

In the experiment, the difference between the short diameter $D_1$ and a long diameter $D_2$ required 0.05 mm or more to recognize the difference.

What is claimed is:

1. A method for producing a spark plug comprising an insulator inserted and affixed within an inner bore of a metal housing provided with a ground electrode, a center electrode inserted and affixed within an inner bore of said insulator wherein a tip of said center electrode and said ground electrode are arranged in opposition, and a precious metal chip composed of precious metal or an alloy of the same being provided on the tip of said center electrode at a location opposite said ground electrode, comprising the steps of:

a flat area formation process which extrudes metal material to form a cylindrical center electrode with a flat area on a side surface of the tip of the same;

a chip bonding process which bonds said precious metal chip to the flat area; and a plastic machining process which forms an abbreviated cylinder by means of plastic machining of the precious metal chip bonded to the tip so that said cylindrical center electrode is formed and the precious metal chip is formed in an arc configuration which is flush with said side surface of said center electrode.

2. The method for producing a spark plug according to claim 1, wherein formation of said flat area is performed during or after the extrusion of the metal material.

3. The method of producing a spark plug according to claim 1, wherein said plastic machining is swaging or component rolling.

4. The method for producing a spark plug according to claim 1, further comprising the steps of:

a mark application process which is provided to create an identification mark for identifying the bonded location of said precious metal chip prior to said plastic machining process;

a leg affixing process which is performed to insert and affix the leg of said center electrode for which the plastic machining process has been carried out within the inner bore of said insulator;

a mounting process which is performed, when inserting and affixing said insulator affixed with said center electrode in the inner bore of said metal housing, to position the location of the identification mark at the prescribed position and to mount and affix said insulator to said metal housing such that said precious metal chip provided on said center electrode is located opposite said ground electrode.

5. The method for producing a spark plug according to claim 4, wherein the identification mark is formed on the surface of the tip of said center electrode.

6. The method for producing a spark plug according to claim 4, wherein the identification mark is formed in the flat area formation process.

7. The method for producing a spark plug according to claim 4, wherein the configuration of the identification mark is one of a groove, protrusion, horn, line, and point.

8. The method for producing a spark plug according to claim 4, wherein the positioning of the identification mark in the mounting process is performed prior to the insertion of said insulator affixed with said center electrode into the inner bore of said metal housing.

* * * * *